US006928759B2

(12) United States Patent
Kasim

(10) Patent No.: US 6,928,759 B2
(45) Date of Patent: Aug. 16, 2005

(54) CONNECTION SYSTEM FOR ATTACHING A WEAR MEMBER TO AN EXCAVATING LIP

(75) Inventor: Rikos A. Kasim, Mukwonago, WI (US)

(73) Assignee: Hornishfeger Technologies, Inc., Wilmington ( * ) Notice: Subject to any disclaimer, the term of this patent is extended or adjusted under 35 U.S.C. 154(b) by 29 days.

(21) Appl. No.: 10/730,450

(22) Filed: Dec. 8, 2003

(65) Prior Publication Data

US 2005/0120596 A1 Jun. 9, 2005

(51) Int. Cl.[7] ..... E02F 9/28
(52) U.S. Cl. ..... 37/452
(58) Field of Search ..... 37/446, 448–456, 37/457, 458; 403/374.3, 374.4, 374.2, 379.4, 403/379.3

(56) References Cited

U.S. PATENT DOCUMENTS

| | | | | |
|---|---|---|---|---|
| 2,167,425 A * | 7/1939 | Page | 37/452 |
| 3,371,437 A * | 3/1968 | Wilson et al. | 37/455 |
| 5,337,495 A | 8/1994 | Pippins | 37/453 |
| 5,713,145 A | 2/1998 | Ruvang | 37/458 |
| 5,724,756 A | 3/1998 | Gale | 37/458 |
| 6,209,238 B1 * | 4/2001 | Ruvang | 37/455 |
| 6,240,663 B1 | 6/2001 | Robinson | 37/458 |
| 6,393,738 B1 | 5/2002 | Bierwith | 37/455 |
| 2003/0037467 A1 | 2/2003 | Bierwith | 37/455 |

* cited by examiner

*Primary Examiner*—Robert E Pezzuto
(74) *Attorney, Agent, or Firm*—James Earl Lowe, Jr.

(57) ABSTRACT

More particularly, this invention provides an excavating lip assembly including a lip. The lip has a surface, and the lip assembly further includes a wear member placed over the lip surface, the wear member having an inner surface, and the inner surface having a bolt securing indentation therein. The lip assembly further includes a holding element in the lip surface, the holding element having an opening there through. The lip assembly also includes a connecting bolt having an end received and held in the indentation, the connecting bolt also being received in the holding element opening. The lip assembly also includes a nut removably received on an end of the bolt to retain the bolt in the holding element opening. More particularly, the connecting bolt is a U-bolt, and wherein the indentation is formed by a half circle element extending from the shroud inner upper surface. The half circle element is cast in the wear element upper surface, and the holding element is a rectangular bar welded to the lip. Still more particularly, the wear member is notched and forms a top flange and a bottom flange, and the wear member inner surface is in the top flange, and the top flange has a cutout therein.

8 Claims, 3 Drawing Sheets

CONNECTION SYSTEM FOR ATTACHING A WEAR MEMBER TO AN EXCAVATING LIP

BACKGROUND OF THE INVENTION

The present invention relates to mining machines including a bucket having a lip, and wear members attached to the lip, and, more particularly, to a mechanism used for attaching the wear member to the lip.

SUMMARY OF THE INVENTION

One of the principal objects of the invention is to provide a simple mechanism for attaching a wear element to a lip of an excavating machine so that the mechanism does not require hammering or other similar operations where parts may come lose or accidental damage may occur.

More particularly, this invention provides an excavating lip assembly including a lip. The lip has a surface, and the lip assembly further includes a wear member placed over the lip surface, the wear member having an inner surface, and the inner surface having a bolt securing indentation therein. The lip assembly further includes a holding element in the lip surface, the holding element having an opening there through. The lip assembly also includes a connecting bolt having an end received and held in the indentation, the connecting bolt also being received in the holding element opening. The lip assembly also includes a nut removably received on an end of the bolt to retain the bolt in the holding element opening.

More particularly, the connecting bolt is a U-bolt, and the indentation is formed by a half circle element extending from the shroud inner upper surface. The half circle element is cast in the wear element upper surface, and the holding element is a rectangular bar welded to the lip. Still more particularly, the wear member is notched and forms a top flange and a bottom flange, and the wear member inner surface is in the top flange, and the top flange has a cutout therein.

Figure 1:
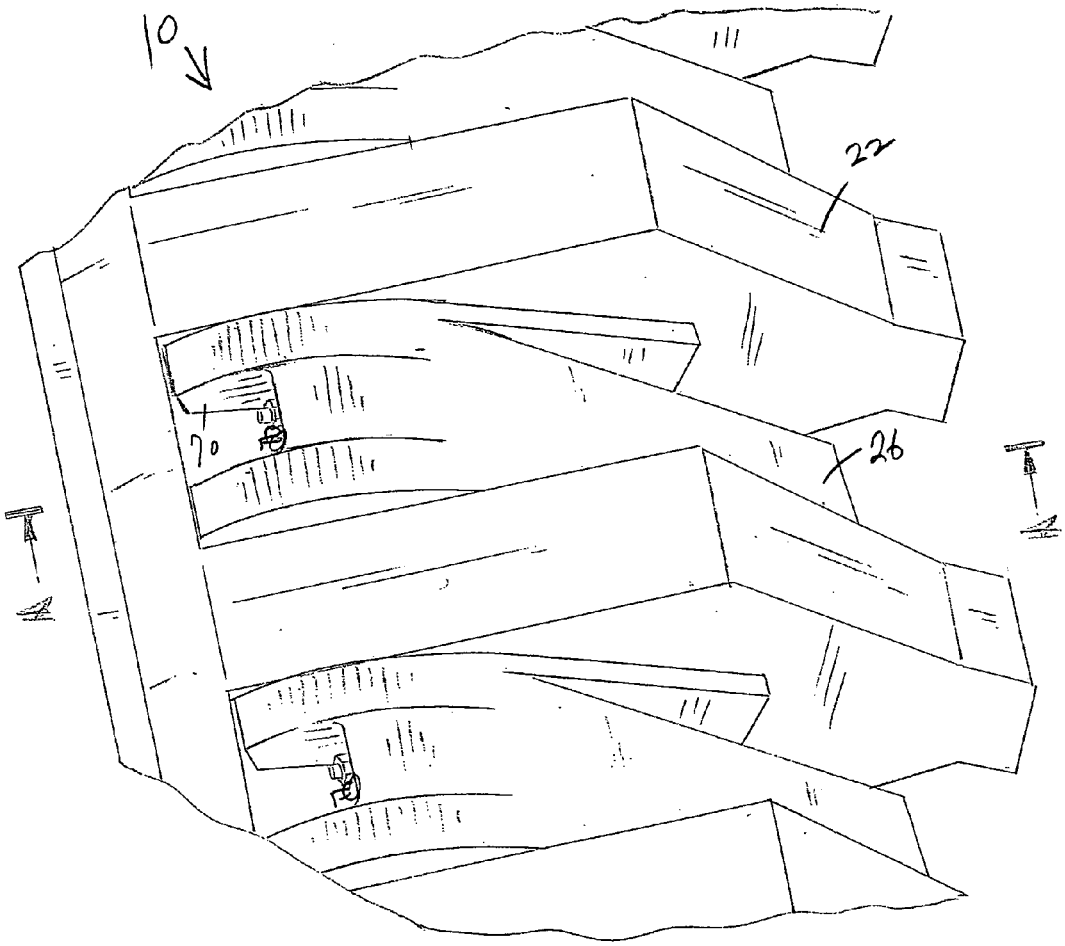
FIG. 1 is a perspective view of part of the lip of bucket on a dragline.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

FIG. 1 shows a top perspective view of a lip assembly 10 according to the invention. The lip assembly includes a dragline bucket 14 (see FIG. 4) having a lip 18 (see FIG. 2) with an upper surface 20. A plurality of tooth assemblies 22 is coupled to the lip 18. Lip shrouds or wear members 26 are respectively disposed between adjacent tooth assemblies 22. The wear members 26 protect the lip 18 from wear. Typically, some or all of the parts of the lip assembly 10 are made of a hard metal such as carbon steel.

Figure 2:
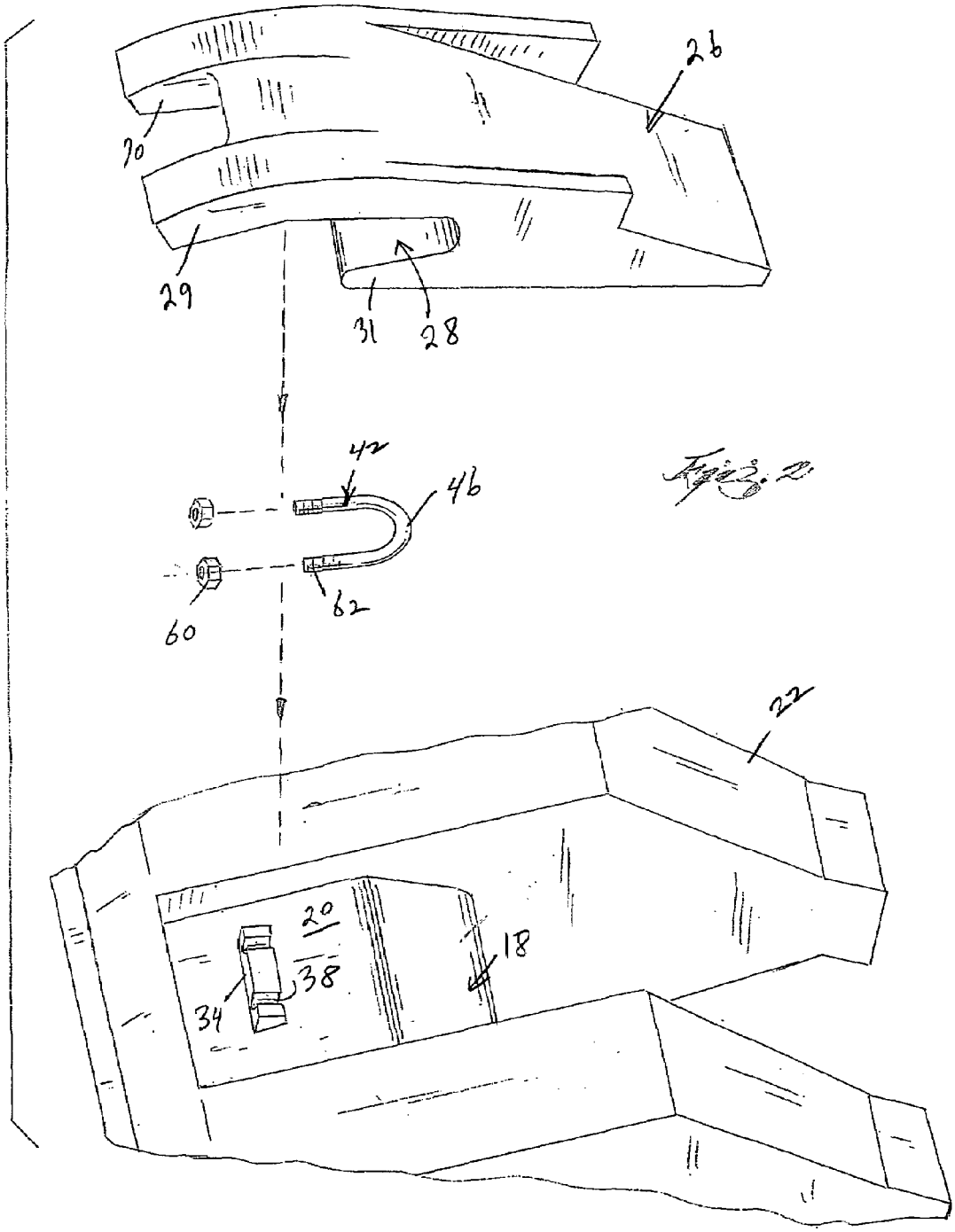
FIG. 2 is an exploded view of a mechanism for attaching a shroud to the bucket lip.
Figure 3:
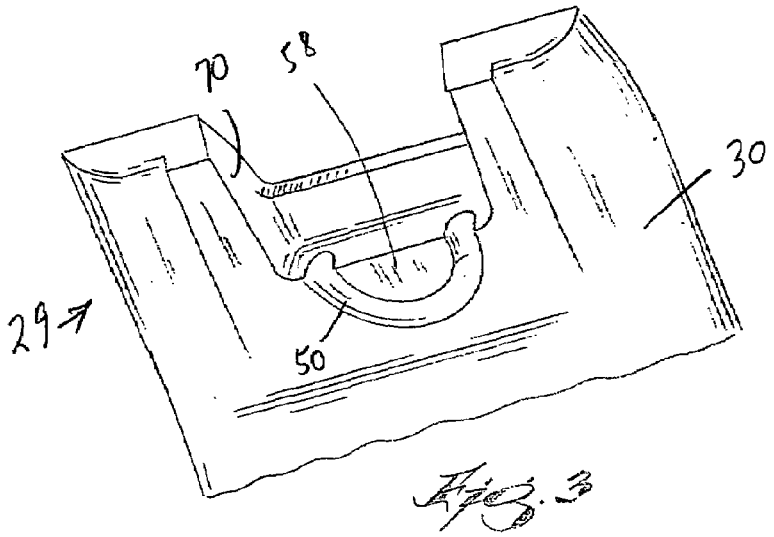
FIG. 3 is a perspective view of the underside of a top flange of the shroud shown in FIGS. 1 and 2.

More particularly, a shown in FIG. 2, the wear member 26 has a generally V-shaped notch 28 therein formed by a top flange 29 and a bottom flange 31 and adapted to receive the lip 18 and extend both over and under the lip 18. As shown in FIG. 3, the top flange 29 has an inner upper surface 30. As shown in FIG. 2, the lip assembly 10 further includes a reaction block or holding element 34 in the lip upper surface 20, the holding element 34 having an opening 38 there through. More particularly, the holding element 34 is in the form of a cast member or a rectangular bar welded to a non-critical area of the lip upper surface 20. In the preferred embodiment, the opening 38 is a recess or indentation in the top of the holding element 34. Still more particularly, there are two spaced apart openings 38 in the holding element 34.

Figure 4:
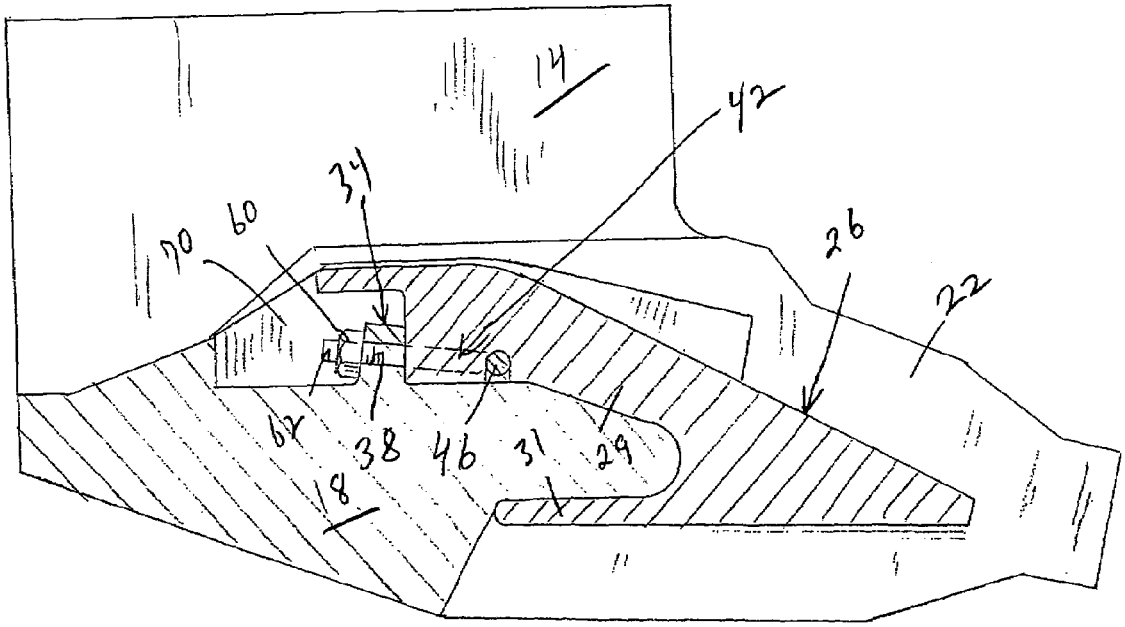
FIG. 4 is a cross section of the shroud, shroud attaching mechanism and the bucket lip, as taken along line 4—4 in FIG. 1.

Still more particularly, as shown in FIGS. 2 and 4, the lip assembly 10 further includes a connecting bolt 42 having an end 46 held in the wear member inner upper surface 30. More particularly, in the preferred embodiment, as shown in FIG. 3, the inner upper surface 30 has a bolt securing recess or indentation 50 therein, and the connecting bolt end 46 is received in and held in the indentation 50. Still more particularly, the connecting bolt 42 is in the form of a U-bolt. A half circle element 58 extends from the shroud inner upper surface 30 and forms the indentation 50. In other less preferred embodiments (not shown), the bolt can be a straight bolt with an enlarged end received in a similarly shaped indentation in the inner upper surface 30.

As shown in FIGS. 2 and 4, the connecting bolt 42 is received in the holding element opening 38, and the lip assembly further includes a nut 60 received on an end 62 of the bolt 42 to retain the bolt 42 in the opening 38 through the holding element 34. More particularly, the U-bolt 42 has two ends 62, and a nut 60 is threaded on each of the ends 62. There is insufficient clearance between the lip 18 and the wear member inner surface 30 to permit the bolt 42 to come out of the recess 38. In other less preferred embodiments (not shown), the opening can be a hole through the holding element 34.

To assembly the shroud or wear member 26 to the lip 18, the U-bolt is placed into the indentation 50 before the wear member 26 is slid over the lip 18. More particularly, during the installation of the lip shroud 26, the threaded U-bolt (1 inch in this case) is fitted to the recess 50 on the lip shroud 26 by some form of grouting. As the wear member 26 is slid along the lip 18, the ends 62 of the U-bolt 42 pass through the openings 38. More particularly, the two ends of the holding element 34 are tapered so as to guide the lip shroud 26 up the lip 18. After passing through the openings 38, the nuts 60 are secured on the U-bolt ends 62. By securing the nuts 60 to the ends of the U-bolt 42, the lip shroud 26 is drawn tight against the lip 18. This prevents any rocking of the lip shroud 26 when the bucket is pulled through the dirt.

To later remove or replace the wear member 26, the nuts 60 are removed from the U-bolt ends 62, and the wear member 26 is slid off of the lip 18.

The lip assembly 10 does not require the use of any hammer (only a wrench for the nuts 60) for a fast and easy installation and removal of the lip shrouds 26. There are no welds at the lip critical areas close to the lip leading edge and close to the lip at the corners where the main section of the lip meets the tooth bases.

As shown in FIGS. 1 through 4, the wear member top flange 29 also has a cutout 70 cut or cast therein. The cutout 70 provides clearance for the holding element 34 and to promote the trapping of the dirt as the bucket is digging. The trapped dirt prevents the erosion of the nuts 60 at the ends of the U-bolt 42.

In the examples shown in the Figures, the bucket lip 18 can be considered a first member and each shroud can be considered a second member. Although a lip 18 and shroud 26 are discussed for purposes of illustration, it is understood that the connection system of this invention can be used to couple any suitable first and second members together, such as teeth on a bucket or a shroud or teeth on a shovel dipper.

Various other features and advantages of the invention will be apparent from the following claims.

What is claimed is:

1. An excavating lip assembly including a lip, said lip having a surface, a wear member placed over said lip surface, said wear member having an inner surface, said inner surface having a bolt securing indentation therein formed by a half circle element extending from the wear member inner surface, a holding element in the lip surface, said holding element having two spaced-apart openings there through, a U-bolt connecting bolt received and held in said indentation, said connecting bolt having two ends, each of which is received in one of said holding element openings, and each of said ends of said bolt to retain said bolt in said holding element opening.

2. An excavating lip assembly in accordance with claim 1 wherein each of said holding element openings is formed by an indentation in said holding element.

3. An excavating lip assembly in accordance with claim 1 wherein said half circle element is cast in the wear member inner surface.

4. An excavating lip assembly in accordance with claim 1 wherein the holding element is a rectangular bar welded to the lip.

5. An excavating lip assembly in accordance with claim 1 wherein the wear member is notched and forms a top flange and a bottom flange, and the wear member inner surface is in said top flange.

6. An excavating lip assembly in accordance with claim 5 wherein the top flange has a cutout therein.

7. An excavating lip assembly including a lip, said lip having an upper surface, a wear member placed over said lip upper surface, said wear member having an inner upper surface, said inner upper surface having a bolt securing indentation therein formed by a half circle element extending from the wear member inner surface, a holding element in the lip upper surface, said holding element having two spaced-apart openings there through, a U-bolt connecting bolt received and held in said indentation, said connecting bolt having two ends, each of which is received in one of said holding element openings, and each of said ends of said bolt to retain said bolt in said holding element opening.

8. An excavating lip assembly in accordance with claim 7 wherein each of said holding element openings is formed by an indentation in said holding element.

* * * * *